United States Patent [19]

Coble

[11] Patent Number: 5,048,802

[45] Date of Patent: Sep. 17, 1991

[54] DIFFUSER SYSTEM FOR ANNEALING FURNACE WITH CHAIN REINFORCED, NODULAR IRON CONVECTOR PLATES

[76] Inventor: Gary L. Coble, RD #2, Box 214, DuBois, Pa. 15801

[21] Appl. No.: 609,643

[22] Filed: Nov. 6, 1990

Related U.S. Application Data

[60] Continuation-in-part of Ser. No. 373,672, Jun. 28, 1989, abandoned, which is a continuation of Ser. No. 213,699, Jun. 30, 1988, abandoned, which is a continuation-in-part of Ser. No. 907,473, Sep. 15, 1986, Pat. No. 4,755,236, which is a division of Ser. No. 732,400, May 9, 1985, Pat. No. 4,611,791, which is a continuation-in-part of Ser. No. 456,823, Jan. 10, 1983, Pat. No. 4,516,758.

[51] Int. Cl.[5] ..... F27B 5/06

[52] U.S. Cl. ..... 266/263; 266/264; 432/260

[58] Field of Search ..... 266/256, 262, 263, 264, 266/274; 428/608; 432/260, 254.1, 254.2

[56] References Cited

U.S. PATENT DOCUMENTS

| | | | |
|---|---|---|---|
| 397,617 | 2/1889 | Tilden | 428/609 |
| 662,344 | 11/1900 | Boyd et al. | 428/579 |
| 1,065,733 | 6/1913 | Schuppener | 428/592 |
| 1,729,848 | 10/1929 | Walker | 164/48 |
| 2,849,219 | 8/1958 | Boron | 263/40 |
| 2,998,236 | 8/1961 | Cramer et al. | 263/40 |
| 3,039,754 | 6/1962 | Jones | 263/47 |
| 3,081,074 | 3/1963 | Blackman et al. | 263/47 |
| 3,149,827 | 9/1964 | Whitten | 263/47 |
| 3,693,955 | 9/1972 | Wald et al. | 266/5 |
| 3,734,699 | 5/1973 | Austermann | 29/191.4 |
| 4,287,940 | 9/1981 | Corbett, Jr. | 165/48 R |
| 4,310,302 | 1/1982 | Thekdi et al. | 432/205 |
| 4,381,336 | 4/1983 | Ostwald | 428/614 |
| 4,516,758 | 5/1985 | Coble | 266/263 |
| 4,611,791 | 9/1986 | Coble | 266/263 |
| 4,749,624 | 6/1988 | Pete et al. | 428/586 |
| 4,755,236 | 7/1988 | Coble | 148/13 |

FOREIGN PATENT DOCUMENTS

| | | | |
|---|---|---|---|
| 1131246 | 12/1956 | Fed. Rep. of Germany | 266/262 |
| 918356 | 2/1963 | United Kingdom | 266/5 |

OTHER PUBLICATIONS

Perrin, Albert R. and Brian F. Johnston, "Batch Anneal Modeling Study", *Iron & Steel Engineer,* vol. 60, No. 6, Jun., 1983, pp. 39–45.

Lee Wilson Engineering Company, Inc., Cleveland, Ohio 44116, 8 page brochure on "Furnaces and Auxiliary Equipment . . . ", date not known.

Lee Wilson Engineering Company, Inc., Cleveland, Ohio 44116, 4 page brochure on "Annealing Furnace Parts", bearing copyright date of 1980.

American Society for Metals, *Metals Handbook Ninth Edition,* vol, 1, pp. 33, 46 & 47, portions of article entitled "Ductile Iron", (1978).

*Primary Examiner*—John P. Sheehan
*Assistant Examiner*—Margery S. Phipps
*Attorney, Agent, or Firm*—David A. Burge

[57] ABSTRACT

A convection diffuser and charge support system for an annealing furnace utilizes a diffuser base assembly to support a stack of coiled rolls of steel that are to be annealed inside a furnace enclosure. The coils are arranged in a vertical stack atop the base assembly. The furnace enclosure surrounds the base assembly and the stack to provide a "closed" treatment environment. Convector plates are interposed between the ends of the coils, with a separate convector plate extending horizontally between each set of adjacent coil ends. Each of the convector plates includes an annular structure 1) that has an inner diameter, 2) that has an outer diameter that extends substantially concentrically about the inner diameter, and 3) that defines a plurality of radially extending air flow passages which extend from locations near the outer diameter to locations near the inner diameter for assisting in providing a desired type of convection flow of gases within the furnace enclosure. The annular structure of each convector plate is formed as a casting of nodular iron. Inner and outer diameter portions of each such annular structure are reinforced with inner and outer endless loops of steel chain, respectively. By providing endless loops of steel chain that are embedded within the cast annular structures of the conrection plates, if one of the cast structures should develop a crack, the endless loops of chain serve as safety devices to minimize the possibility that relatively large pieces of the broken plate will shatter or separate unexpectedly.

13 Claims, 9 Drawing Sheets

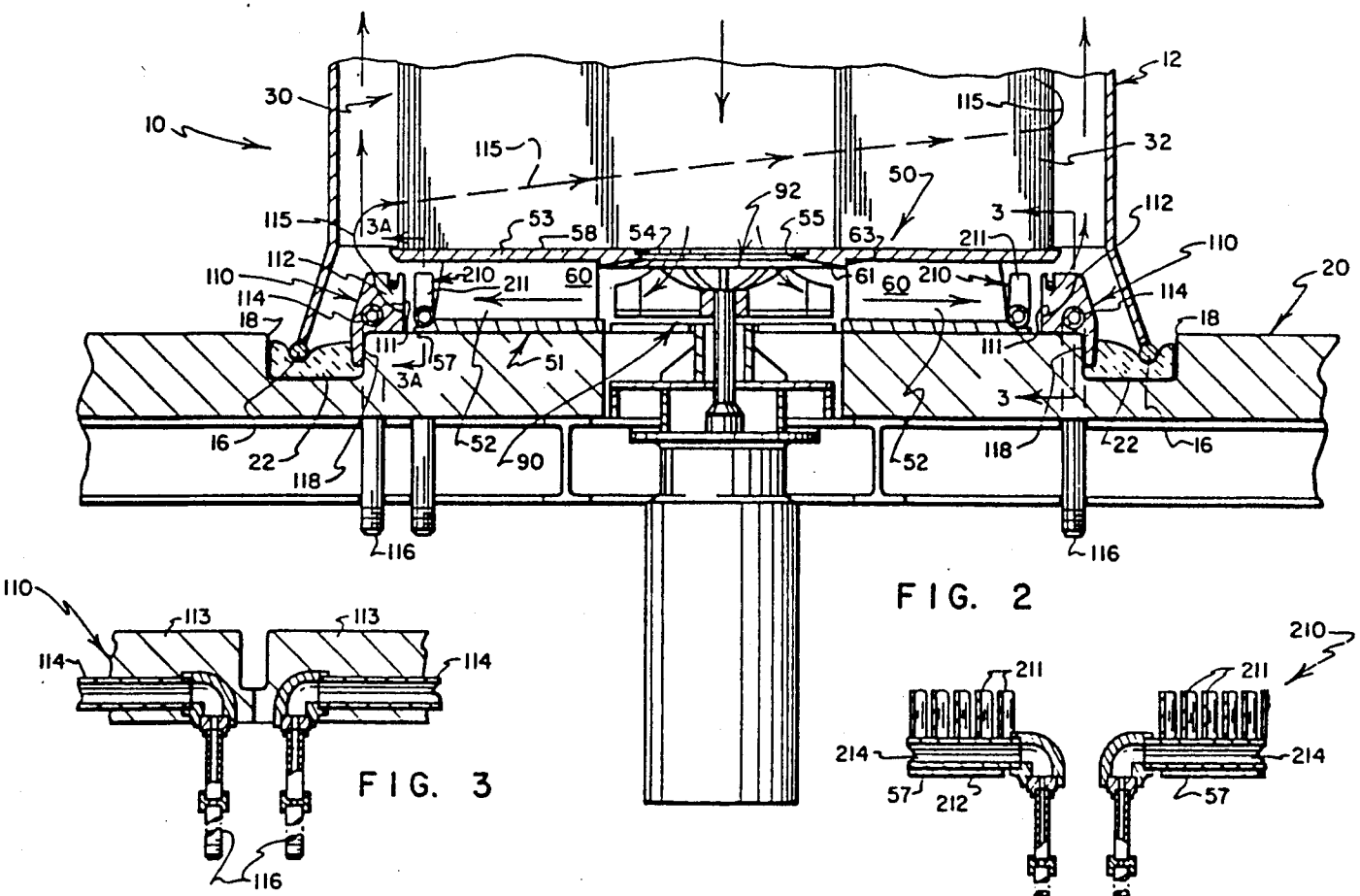
FIG. 2
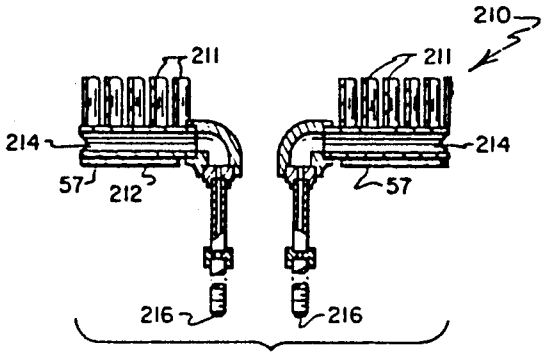
FIG. 3A
FIG. 3

DIFFUSER SYSTEM FOR ANNEALING FURNACE WITH CHAIN REINFORCED, NODULAR IRON CONVECTOR PLATES

CROSS-REFERENCE TO RELATED PATENTS AND APPLICATIONS

The present application is a continuation-in-part of application U.S. Ser. No. 07/373,672 filed 06/28/89, referred to hereinafter as the "Parent Case," (abandoned) which case was, in turn, filed as a continuation of application U.S. Ser. No. 07/213,699 filed 06/30/88 (abandoned), which case was, in turn, filed as a continuation-in-part of application U.S. Ser. No. 06/907,473 filed 09/15/86 (issued 07/05/88 as U.S. Pat. No. 4,755,236), which, in turn, was filed as a division of application U.S. Ser. No. 06/732,400 filed 05/09/85 (issued 09/16/86 as U.S. Pat. No. 4,611,791), which, in urn, was filed as a continuation-in-part of application U.S. Ser. No. 06/456,823 filed 01/10/83 (issued 05/14/85 as U.S. Pat. No. 4,516,758). The disclosures of all of the cross-referenced applications and patents that are identified above are incorporated herein by reference.

BACKGROUND OF THE INVENTION

1. Field of the Invention

The present invention relates generally to the heat treating process known as annealing. More particularly, the present invention relates to the provision of and the use within annealing processes of a particularly long-lived and durable type of convection diffuser plate hat incorporates a significant safety feature in the form of at least one endless loop of steel chain that is embedded in the cast nodular iron material of the plate structure to minimize the possibility that relatively large portions of a cracked or broken convection diffuser plate will shatter or separate unexpectedly.

2. Prior Art

Working in the environment of a steel production plant has always involved elements of risk Massive machinery is used to process massive quantities of product as by using extreme heat and high pressure, with cranes and other mechanisms being used to move quantities of product between workstations and/or between workstations and areas of storage.

In such an environment, it is desirable to take precautions to avoid breakage of machine components. However, because machine component breakage cannot be entirely prevented, it also is desirable to take precautions to assure that if and when component breakage occurs, the resulting injury to persons and the resulting damage to property is minimized.

The reasons why component breakage occurs are many and varied. Useful life often is significantly diminished due to the deleterious effects of repeated cycles of heating and cooling to which many components in a steel production facility are subjected. Likewise, as heavy components and heavy quantities of product are moved about as by cranes, unintended impacts sometimes take place. These and many other factors contribute to component failure, and can cause components to crack, break and/or shatter unexpectedly.

In an annealing furnace, a fixed base typically is used to support a vertical stack of coils of steel product; a open-bottom tank-like enclosure is lowered in place to enclose the stack and to mate with the base to establish a controllable environment within which the coils are enclosed; and, the coils are heated and then cooled in this environment, in a controlled manner that causes properties of the steel to be desirably enhanced.

Maintaining a controlled convection flow of gases within the environment of an annealing furnace is an important aspect of the annealing process. Convection flow is permitted to take place between adjacent end regions of the stacked coils by inserting heavy, complexly configured convector plates between the adjacent end regions of adjacent pairs of coils. The convector plates typically are of substantially annular shape so as to define substantially concentric inner and outer diameters, and have formations that define a plurality of radially extending gas flow passages extending between outer and inner diameter regions of the convector plates.

Of all of the components that comprise an annealing furnace, its convector plates tend to be particularly prone to failure. Due to the need for the convector plates to be able to support multi-ton coils of steel in stable, spaced, stacked relationship, the convector plates are, of necessity, quite heavy, and typically are moved into and out of position using a crane. Due to the need for the convector plates to define a plurality of substantially radially extending gas flow passages, the convector plates tend to be relatively complexly configured structures that employ an array of formations which, when viewed in cross section, vary from relatively thick to relatively thin. Thus, despite their massive size and weight, convector plates often are of relatively breakable character and benefit from being handled relatively gently.

Because convector plates are subjected to repeated cycles of heating and cooling, and because they often are moved about relatively roughly as coils are being "stacked" and "unstacked" before and after their being treated within the enclosures of annealing furnaces, it is not unusual for cracks to form that lead to breakage. Nor is it unusual for convector plates to "shatter" or to fail as by literally "falling apart" while they are being moved by cranes. If a convector plate shatters or breaks such that sizable pieces are caused to drop from a crane, serious injuries and/or significant property damage can result. Thus, to the extent that the longevity of the service life of convector plates can be enhanced, and to the extent that shattering or catastrophic breakage of failed convector plates can be minimized, these are worthy objectives.

The referenced Parent Case seeks to address such needs by providing convector plates that are cast from nodular iron, and that are reinforced with rigid steel bars. While the use of nodular iron has proved to enhance the longevity of service of convector plates, the use of rigid steel reinforcement bars has not proven to be particularly helpful in holding together the parts of broken convector plates, whereby the problems of shattering and of sizable pieces of failed convector plates dropping from cranes during transport has remained unsolved.

SUMMARY OF THE INVENTION

The present invention relates to the provision and use of chain-reinforced convector plates of generally annular shape that are cast from nodular iron, with the convector plates being configured for use between adjacent ends of adjacent coils of steel that are arranged in a stack atop a base of an annealing furnace. In preferred practice, an enveloping enclosure of the annealing furnace extends about the stack to define a "closed" treatment environment within which gases are circulated, and the convector plates have formations that help to duct gases in generally radially extending directions between adjacent end regions of adjacent ones of the coils.

At least one endless loop of chain preferably is embedded within the cast structure that forms each of the substantially annular convector plates. In preferred practice, each convector plate has inner and outer diameters that extend substantially concentrically, and at least two endless loops of chain are used in forming the annular convector plate structure, namely an inner loop that extends substantially concentrically through inner diameter portions of the cast structure of the convector plate, and an outer loop that extends substantially concentrically through outer diameter portions of the convector plate. Radially extending gas flow passages are defined by convector plate formations that extend substantially radially between the outer and inner diameter regions. The passages duct gases between adjacent ends of adjacent coils, and help to achieve uniform processing of the steel that comprises the stacked coils.

In accordance with one feature of the present invention, each of the convector plates is formed as a chain reinforced casting of nodular iron to provide a highly durable structure that will withstand repeated cycles of high heat, and to retain integrity during handling as coils are stacked into and removed from the furnace. Nodular iron is cast iron which has been treated while in a molten state with an alloy that contains an element such as magnesium which favors the formation of spheroidal graphite when the cast iron solidifies, whereby the resulting product is more ductile and durable than normal cast iron. While nodular iron is advantageously utilized to form components in such high-heat environments as are prevalent in annealing furnaces to provide components that will be long-lived despite the deleterious effects of the environment, nodular iron components tend to lack a desired degree of ductility, and can break and shatter if they are dropped or roughly impacted.

Because convector plates often are "banged about" by hoist-carried magnets and other types of handling equipment during the stacking and unstacking of coils of steel atop the base assemblies of annealing furnaces, it is desirable to form convector plates in such a way that the plates resist breakage and shattering if they are dropped or impacted during normal handling. The present invention utilizes the desirable long-lived characteristics of nodular iron in the formation of convector plates, and addresses breakage and shattering concerns by forming the plates as castings that have embedded therein steel chain that serves to reinforce the nodular iron and to hold large pieces of broken convector plates together to prevent convector plate shattering and to minimize concerns about sizable pieces of convector plates dropping from cranes during transport.

BRIEF DESCRIPTION OF THE DRAWINGS

Other features and a fuller understanding of the invention may be had by referring to the following description and claims taken in conjunction with the accompanying drawings, wherein:

FIG. 2 is an enlargement of a lower portion of the apparatus of FIG. 1;

FIGS. 3 and 3A are sectional views of the outer and inner cooling rings, as seen from planes indicated by lines 3—3 and 3A—3A, respectively, in FIG. 2;

DESCRIPTION OF THE PREFERRED EMBODIMENT

Figure 1:
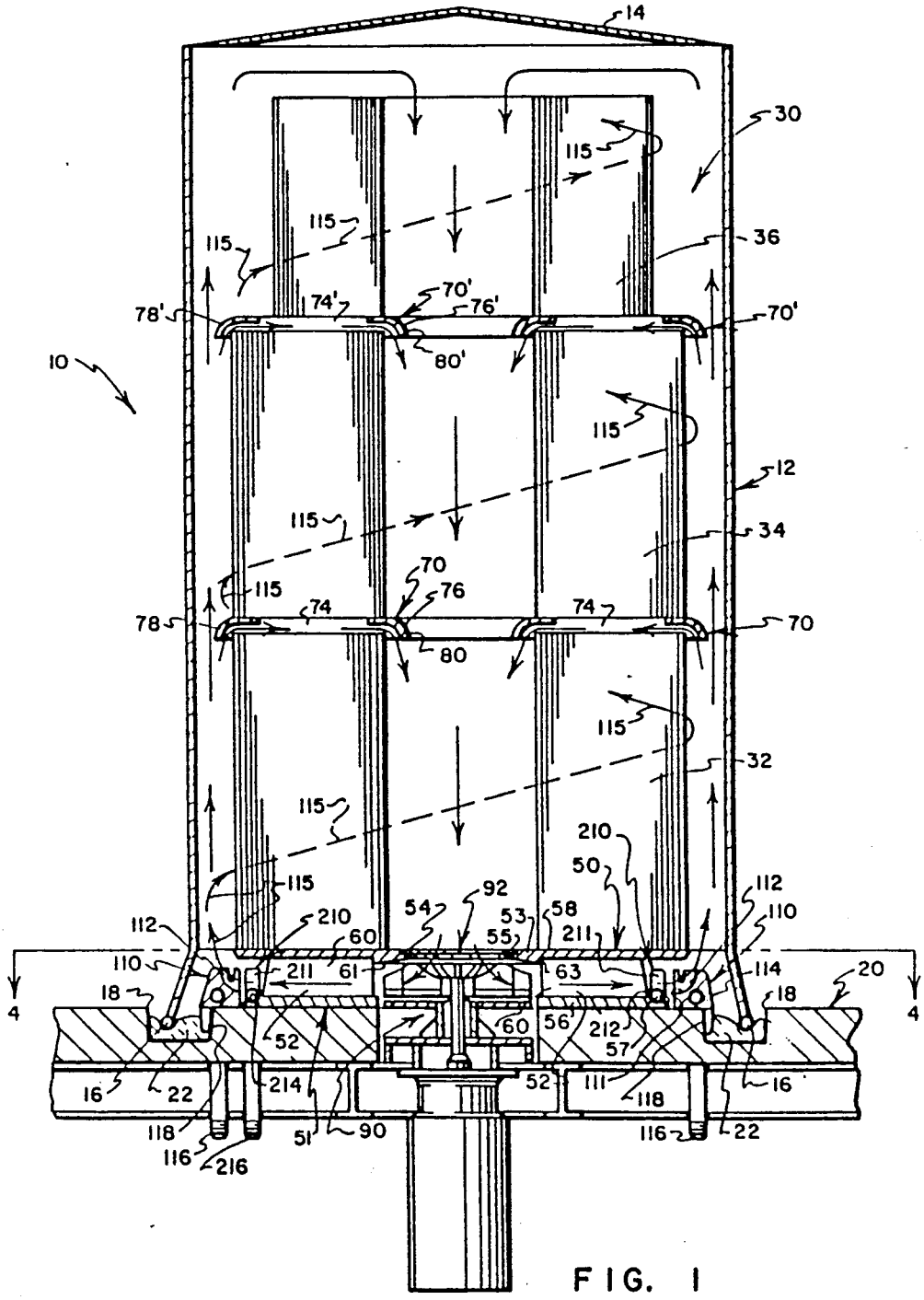
FIG. 1 is a vertical cross-sectional view of portions of a heat-treating apparatus depicting, somewhat schematically, novel and improved features of the convection diffuser and charge support system of the present invention.

Referring to FIG. 1, a heat-treating apparatus known as an annealing furnace is indicated generally by the numeral 10. The apparatus or furnace 10 is of the general type that is disclosed in the several cases that are cross-referenced at the beginning of the present document.

The furnace 10 includes a conventional, generally cylindrical enclosure 12 having a closed upper end 14 and an open lower end defined by a rim 16. The rim 16 extends into an upwardly-opening annular groove 18 defined by a conventional support structure 20. The groove 18 is provided with a seal 22 of suitable material such as ceramic fiber refractory to prevent leakage of such gases as are supplied (in a conventional manner by conduits which are not shown) to the interior of the enclosure 12 to provide a positive pressure, non-oxidizing atmosphere within the enclosure 12. Housed within the enclosure 12 is a charge 30 of material to be annealed, depicted in FIG. 1 as including a vertical stack 30 of three coils of steel 32, 34, 36.

A diffuser base and support structure, indicated generally by the numeral 50, underlies and supports the lowermost coil 32. A convector plate 70 is positioned between the coils 32, 34. An identical convector plate 70' is positioned between the coils 34, 36. Because the use and construction of the convector plates 70, 70' involves features of the present invention, a fuller discussion of construction and use of the convector plates 70, 70' is presented later in this description of the preferred practice of the present invention.

A fan 90 having a rotary impeller 92 is disposed substantially centrally with respect to the diffuser base 50 for circulating non-oxidizing gases within the closed environment of the enclosure 12. The diffuser base and support structure 50 is shown somewhat schematically in FIGS. 1 and 2 as defining gas flow passages 52 which extend horizontally outwardly from the vicinity of the fan 90 to the vicinity of a pair of outer and inner cooling ring structures 110, 210. The outer cooling ring structure 110 has grooves 111 formed therein that cooperate to define curved, upwardly turned gas flow passages 112 for receiving gases that discharge radially outwardly from the passages 52 under the influence of the fan 90, and for directing these gases outwardly and upwardly along helical flow paths about the outer surfaces of the stack 30 of coils 32, 34, 36, as is indicated generally by arrows 115. The inner cooling ring structure 210 has heat exchange fins 211 that project into the paths of gases that discharge from the passages 52 for cooling these gases as they travel toward the passages 112, as will be explained.

The diffuser base 50 includes a center casting 51 that has a central opening 54 which surrounds the impeller 92 of the fan 90, and an overlying charge support plate 53 which has a relatively smaller diameter central opening 55 located atop the impeller 92 of the fan 90. The center casting 51 and the charge plate 53 cooperate to protectively shield portions of the impeller 92 of the fan 90, and to facilitate establishing efficient, directionally controlled flows of gases within the environment of the furnace enclosure 12.

Referring to FIGS. 4, 5, 10 and 11 the center casting 51 of the diffuser base 50 includes a bottom wall 56 of annular, substantially planar configuration. A perimetrically extending lip 57 projects radially outwardly along the circumference of the bottom wall 56 to define an upwardly facing ledge for receiving and supporting the inner cooling ring 210. A plurality of curved vane formations 60 extend vertically upwardly from the bottom wall 56 and are formed integrally therewith.

Figure 12:
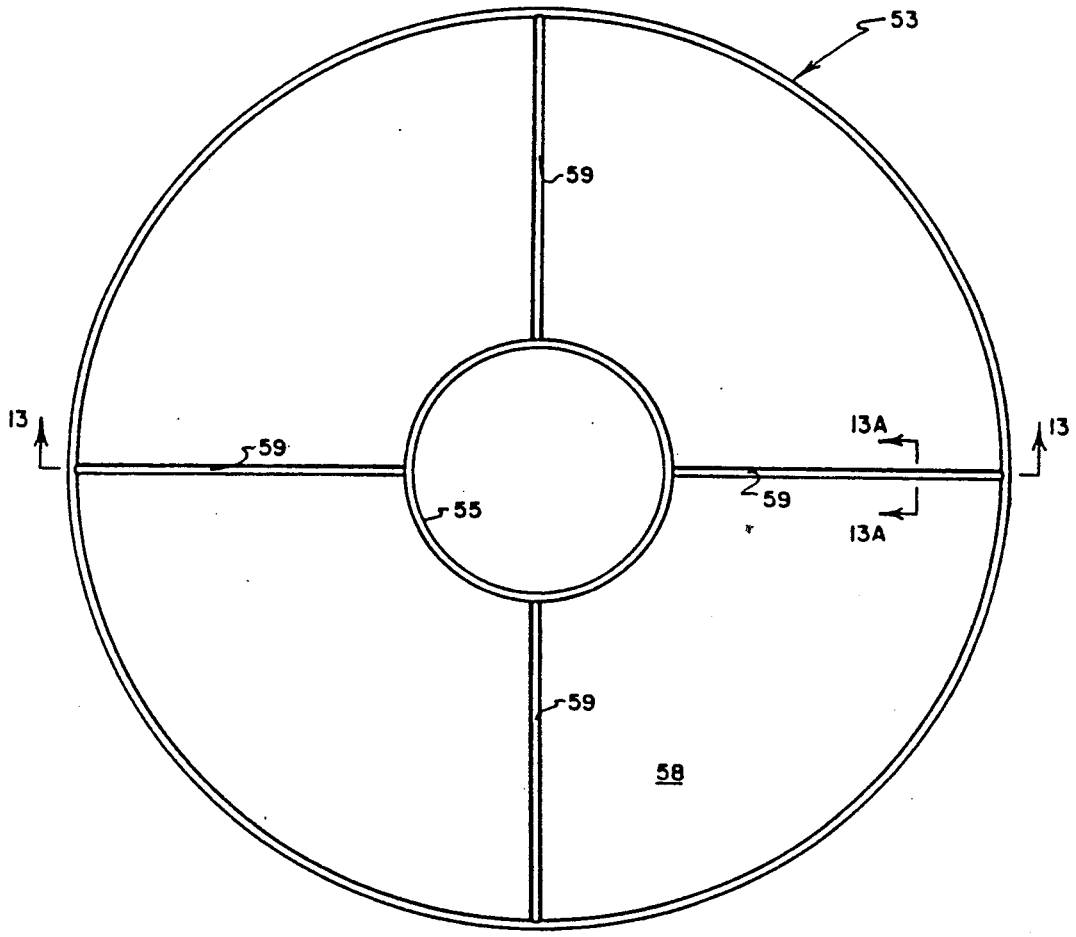
FIG. 12 is a top plan view of the charge support plate of the diffuser base assembly.
Figure 13:
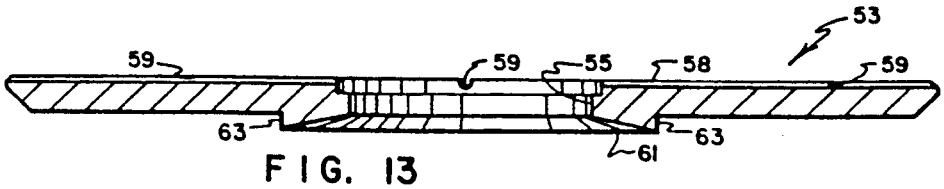
FIGS. 13 and 13A are sectional views as seen from planes indicated by lines 13—13 and 13A—13A, respectively, in FIG. 12.
Figure 13A:
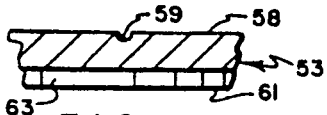
Figure 14:
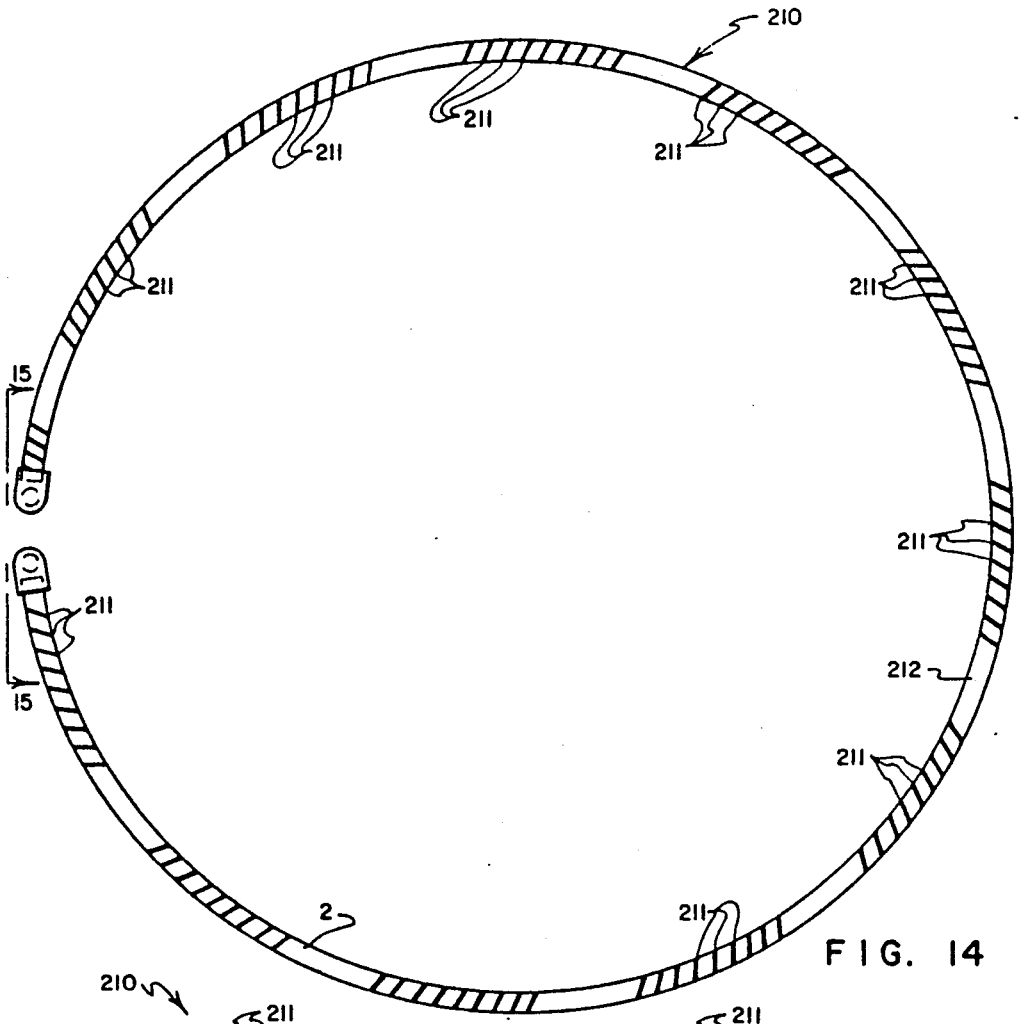
FIG. 14 is a top plan view of the inner cooling ring of the diffuser base assembly; and, FIG. 15 is a side elevational view, on an enlarged scale, of portions of the inner cooling ring, as seen from a plane indicated by a line 15—15 in FIG. 14.
Figure 15:
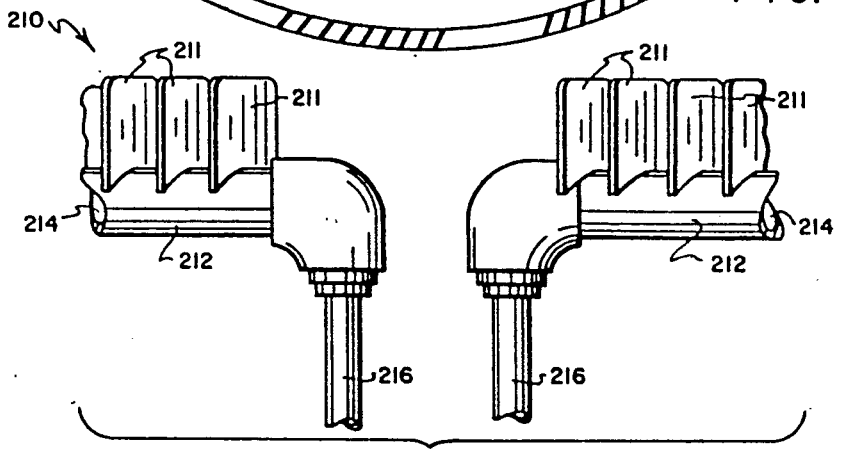

Referring to FIGS. 4, 5, 12 and 13, the charge support plate 53 defines a generally planar top wall 58 that rests atop the vane formations 60 and cooperates therewith to define the flow passages 52 that are curved (as viewed from above), shielded, horizontally-extending channels through which gases from the fan impeller 92 flow as they are directed radially outwardly. As is best seen in FIGS. 1, 2 and 13, the charge plate 53 has an annular dependency 61 that surrounds the central opening 55 and projects a short distance into the space that is centrally located among the inner ends of the vanes 60 of the center casting 51. The dependency 61 has a circumferentially extending shoulder 63 that engages the inner ends of at least some of the vanes 60 to interlock the charge support plate 53 and the center casting 51 and to prevent undesired relative movement thereof. The top wall 58 extends radially outwardly for a distance that is slightly farther than does the bottom wall 56 (i.e., the outer diameter of the top wall 58 is greater than the outer diameter of the bottom wall 56), whereby the top wall 58 serves to shield not only the inner cooling ring structure 210 but also radially inward portions of the outer cooling ring structure 110 (including the inner end regions of the curved passages 112 which are formed as grooves 111 in the outer ring structure 110). The top wall 58 of the charge support plate 53 serves to engage and support the lowermost coil 32 of the charge 30 of metal to be annealed.

Figure 4:
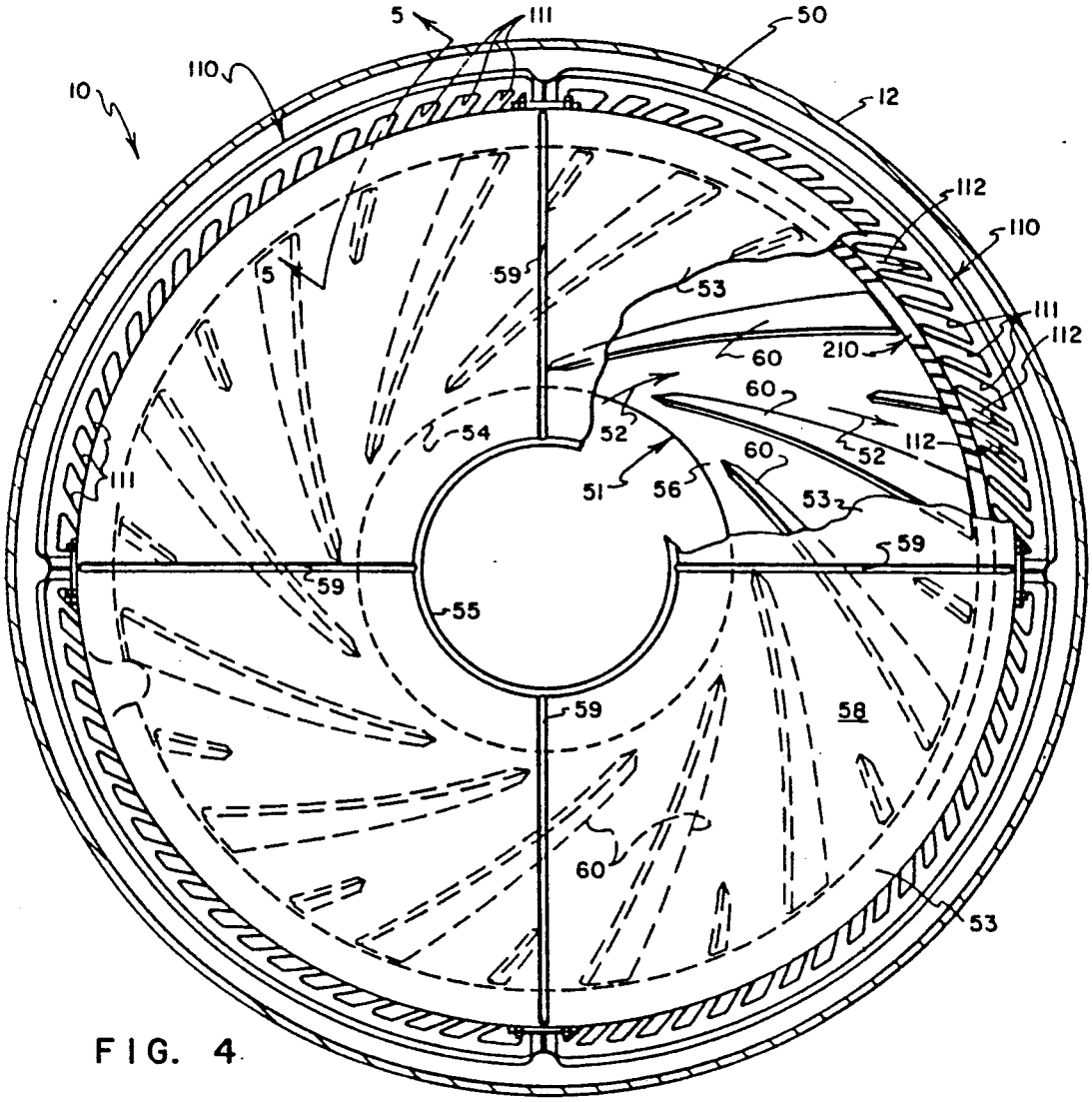
FIG. 4 is a sectional view, on an enlarged scale, as seen from a plane indicated by a line 4—4 in FIG. 1, with the plane of the section being selected to provide a top plan view of a diffuser base assembly that is employed in the apparatus of FIG. 1, wherein the diffuser base assembly includes as its major components a center casting, a charge support plate, and a pair of outer and inner cooling rings, but with a portion of the charge support plate being broken away to permit viewing of underlying 1) vanes of the center casting, 2) grooves of the outer cooling ring, and 3) fins of the inner cooling ring, with the view further including dotted lines that depict vane, groove and fin features of the center casting, the outer ring and the inner ring, respectively.
Figure 5:
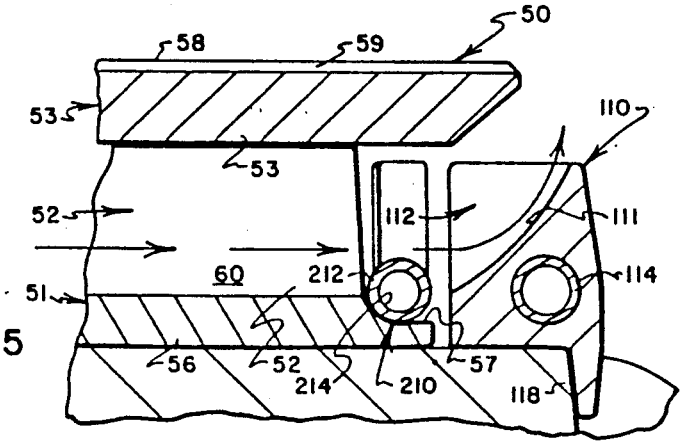
FIG. 5 is a somewhat schematic sectional view, on an enlarged scale, as seen from planes indicated generally by a curved line 5—5 in FIG. 4.
Figure 6:
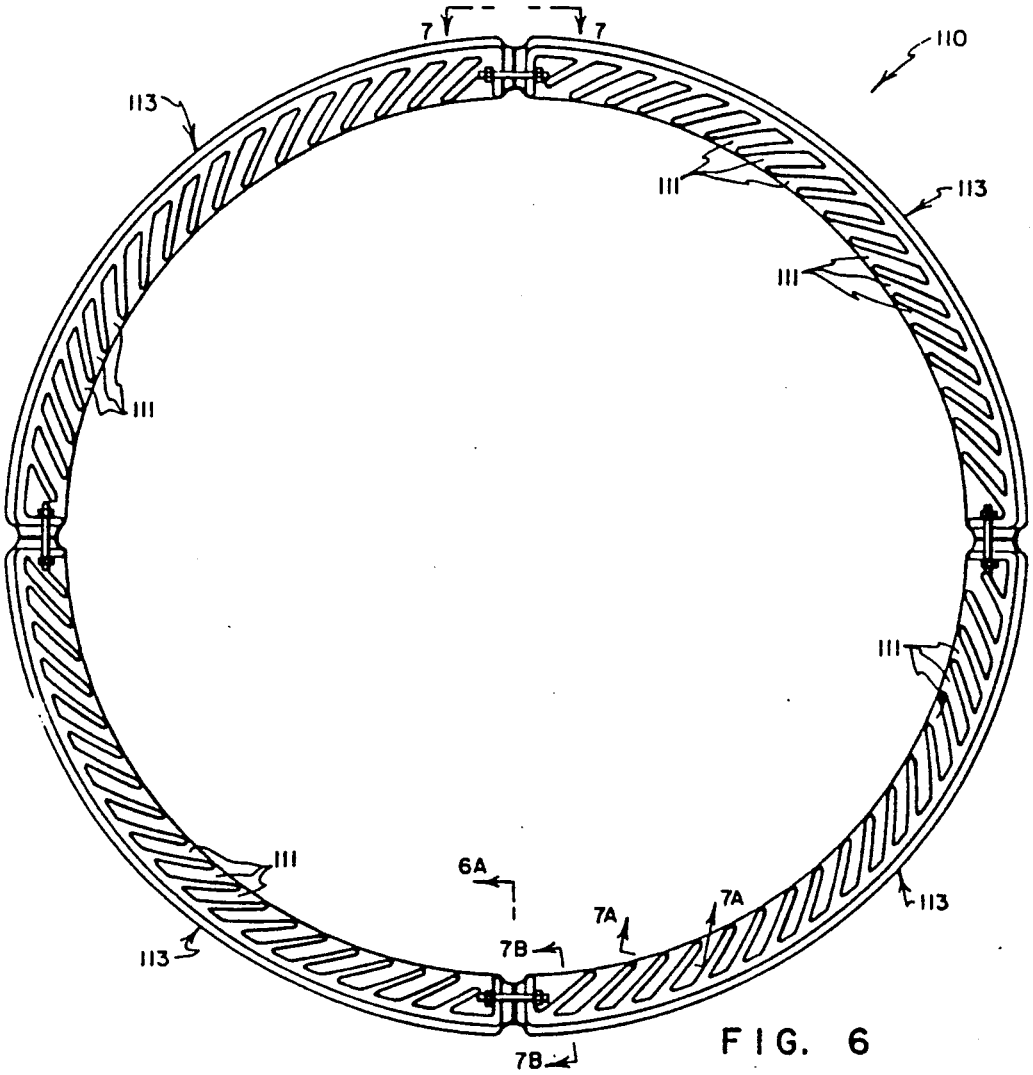
FIG. 6 is a top plan view of the bolted-together assembly of castings that forms the outer cooling ring of the diffuser base assembly.
Figure 6A:
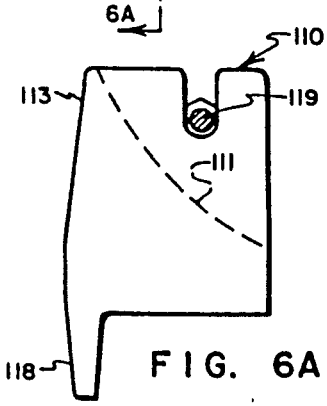
FIG. 6A is a sectional view, on an enlarged scale, as seen from a plane indicated by a line 6A—6A in FIG. 6.
Figure 7:
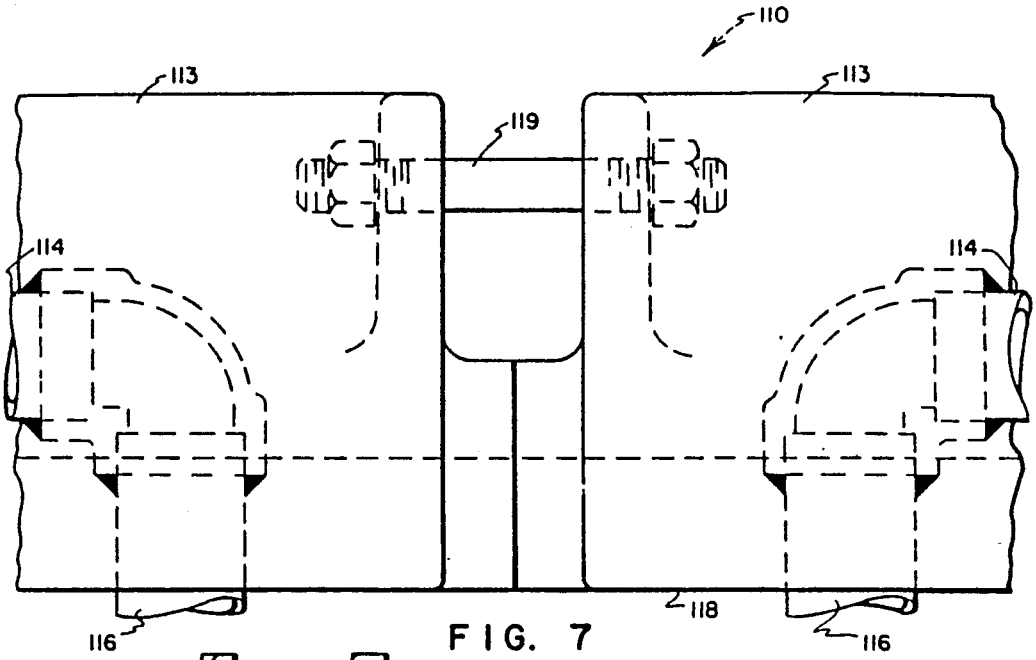
FIG. 7 is a side elevational view, on an enlarged scale, of portions of the outer cooling ring, as seen from a plane indicated by a line 7—7 in FIG. 6.
Figure 7A:
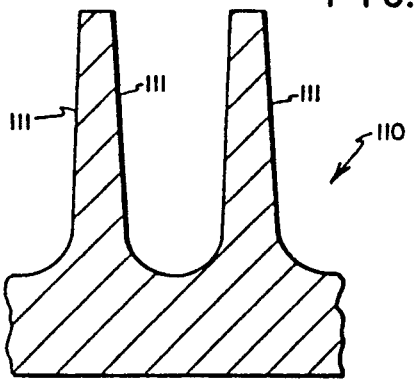
FIGS. 7A and 7B are sectional views, on an enlarged scale, as seen from planes indicated by lines 7A—7A and 7B—7B, respectively, in FIG. 6.
Figure 7B:
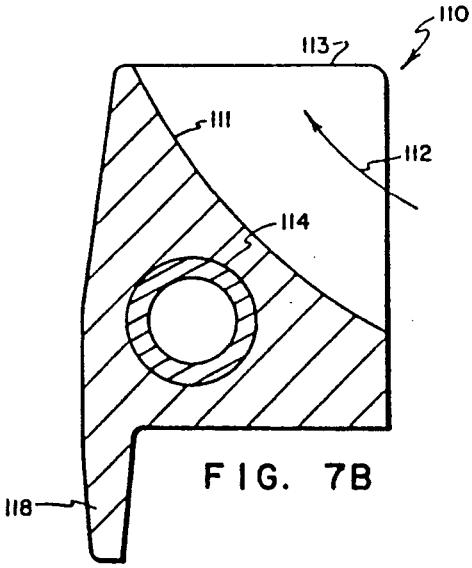

Referring to FIGS. 4–6, the outer cooling ring structure 110 extends perimetrically about portions of the center casting 51 and provides a spaced array of the grooves 111 (located at spaced locations extending along substantially the entire length of the ring 110). Referring to FIGS. 4, 5, 14 and 15, the inner ring structure 210 resides atop the ledge 57 such that it closely perimetrically surrounds the center casting 51 at a location that is spaced radially inwardly from the outer cooling ring 110. The inner cooling ring 210 has a plurality of fins 211 that are arranged in groups (typically of eight or nine relatively closely spaced fins), with the groups of fins 211 being spaced along the circumferential length of the underlying tube 212. The fins 211 cooperate with the vanes 60 of the center casting 51 and with the grooves 111 of the outer cooling ring structure 110 to duct gases that discharge horizontally from the passages 52 into the curved, upwardly turned passages 112. The vanes 60, the grooves 111, and the fins 211 cooperate to effect an advantageous directing of the flows of gases from the fan 90 so that these gas flows travel radially outwardly among the vanes 60 of the center casting 51, among the fins 211 of the inner ring 210, through the grooves 111 of the outer cooling ring 110, and then upwardly along substantially helical flow paths extending about the stack of coils 30, as is indicated in FIGS. 1 and 2 by the arrows 115.

As is best seen in FIGS. 2, 3, 5, 7 and 7B, the base-encircling outer cooling ring structure 110 is preferably formed as a bolted-together assembly of castings 113 that take the form of identical arcuate segments. Each of the castings 113 has embedded integrally within it a fluid cooling conduit 114. The conduits 114 have end portions 116 which depend for connection to a conventional fluid circulation unit (not shown). The cooling conduits 114 are utilized during the cooling part of an annealing cycle to diminish the temperature of the castings 113 of the outer ring 110 so that the outer ring 110 can likewise serve to reduce the temperature of the gases being circulated within the closed, controlled environment of the enclosure 12, as will be explained in greater detail.

As is best seen in FIGS. 2, 3A, 5, 14 and 15, the tube 212 of the inner ring structure 210 defines a cooling conduit 214 that has end portions 216 which depend for connection to a conventional fluid circulation unit (not shown). The conduit 214 and its heat conductive fins 211 are utilized during the cooling part of an annealing cycle to reduce the temperature of the gases being circulated within the closed, controlled environment of the enclosure 12, as will be explained in greater detail.

The cooling conduits 114 that extend through the outer ring segments 113 are formed by pre-forming lengths of steel pipe to assume the desired configurations of the cooling conduits 114, filling the pipes with mold sand, positioning the pipes in sand molds which are configured to form the desired shapes of such nodular iron castings as are required to form the segments 113 of the outer ring structure 110 (with the pipes positioned in the molds in the exact positions where it is desired to provide cooling conduits, and with end portions 116 of the pipes projecting beyond the mold cavities defined by the molds), where after molten iron is poured into the molds in the conventional manner to form the castings 113. After pouring and cooling, the castings 113 are removed from their molds, the sand is removed from the interior of the cooling conduits 114, and the cast segments 113 of the ring structure 110 are then connected by bolts 119, as shown in FIGS. 5, 6, 6A and 7, to form the completed outer ring structure 110.

If necessary to accommodate the diameter of a particular center casting 51, metal spacer blocks (not shown) may be installed between the bolted-together ends of the segments 113. By forming the outer cooling ring or "heat sink" 110 as cast segments that are bolted together, ring segments 113 having a given radius of curvature can be utilized, either with or without suitable space blocks (not shown) positioned between their bolted-together ends, to function about the periphery of center casting 51 of a range of outer diameters.

As is best seen in FIGS. 1, 2, 5, 6A, 7 and 7B, the outer ring structure 110 has, depending from its perimeter, a substantially continuous skirt 118 which extends into the upwardly opening groove 18 for engaging and sealing with the ceramic fiber refractory material 22 carried within the groove 18. The skirt 118 not only assists in preventing ambient air from entering the closed, controlled environment of the apparatus 10, but also serves to surround and shield from deterioration such portions of the furnace as underlie the ring structure 110.

Figure 8:
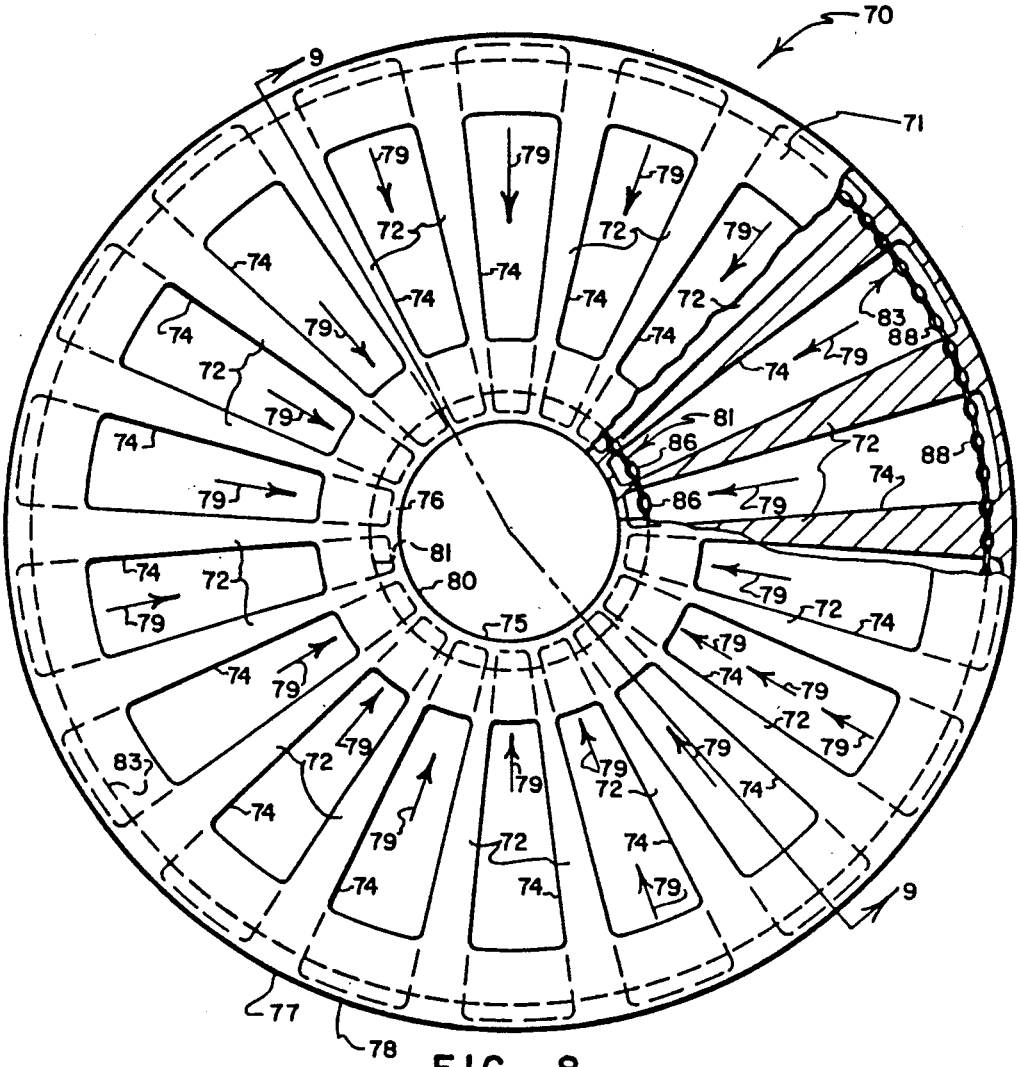
FIG. 8 is a top plan view of one of a plurality of convector plates that are utilized to separate vertically stacked coils of a charge of metal that is positioned for treatment within the confines of the apparatus of FIG. 1, with a pair of endless loops of steel chain (about which the nodular iron of the convector plate is cast) being depicted in phantom except where portions of the nodular iron casting are broken away.
Figure 9:
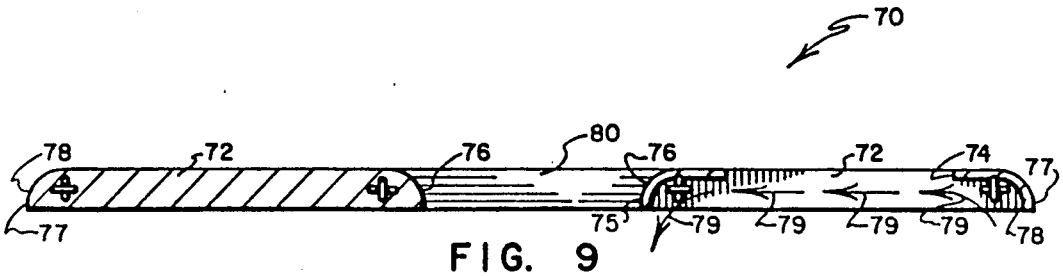
FIG. 9 is a sectional view as seen from planes indicated by a broken line 9—9 in FIG. 8.
Figure 10:
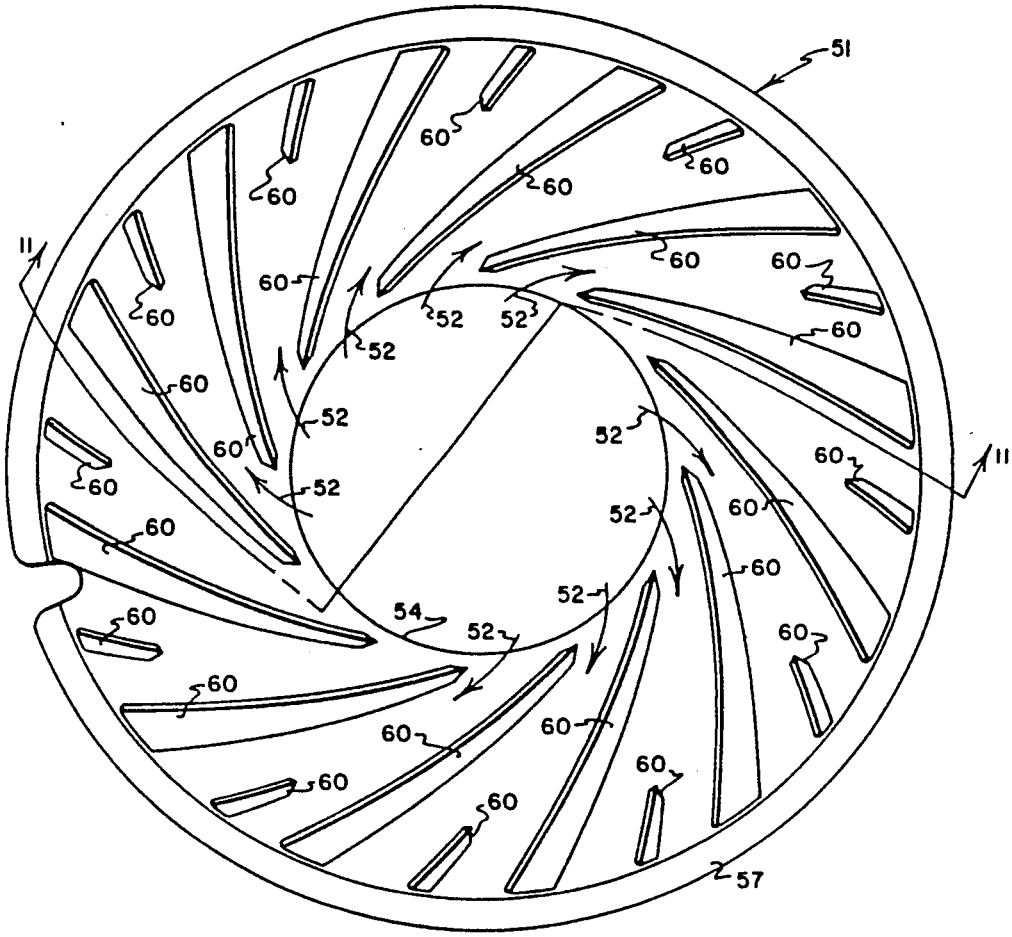
FIG. 10 is a top plan view of the center casting of the diffuser base assembly.
Figure 11:
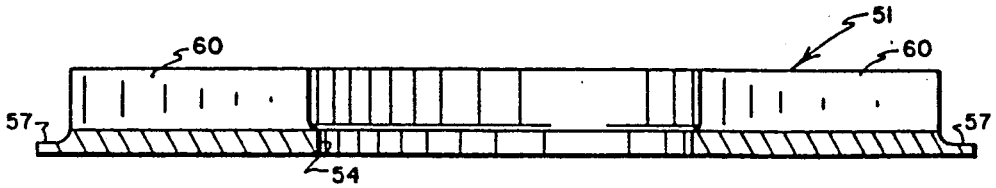
FIG. 11 is a sectional view as seen from planes indicated by a broken line 11—11 in FIG. 10.

Referring to FIGS. 8 and 9 in conjunction with FIG. 1, the convector plate 70 is shown as being formed essentially as a one-piece casting 71; however, the casting 71 has at least partially embedded therein both an inner endless loop of steel chain 81, and an outer endless loop of chain 83, with the inner and outer loops 81, 83 extending, respectively, through inner and outer diameter portions of the material of the casting 71, as will be explained.

The casting 71 has a generally annular configuration, with curved inner and outer formations 76, 78 that extend in substantially concentric circles so as to define inner and outer diameters 75, 77, respectively, of the casting 71. The inner and outer loops of chain 81, 83 extend along substantially circular paths that are substantially concentric. The path followed by the inner loop of chain 81 extends relatively near to (but is spaced radially outwardly at a substantially constant distance from) the inner diameter 75. The path followed by the outer loop of chain 83 extends relatively near to (but is spaced radially inwardly at a substantially constant distance from) the outer diameter 77.

The casting 71 includes a plurality of radially extending support ribs 72 that are arranged in a spaced array like the spokes of a wheel so as to define an array of radially extending open sectors 74 that are located among the support ribs 72. As is best seen in FIG. 9, curved inner and outer formations 76, 78 of the casting 71 are provided at the inner and outer ends of the open sectors 74 (i.e., along the inner and outer edges 75, 77, respectively) for providing radially extending flow passages which are indicated by the arrows 79. The flow passages 79 facilitate the flow of non-oxidizing gases between adjacent end regions of the stacked coils 32, 34 (in directions that are indicated in FIGS. 8 and 9 by the arrows 79) during operation of the furnace 10.

The inner diameter or inner edge 75 defines a central opening or restricted flow orifice 80, the size of which preferably is selected to assist in providing the desired type of gas flow circulation within the controlled, closed environment of the furnace 10, as will be readily understood by those who are skilled in the art. Likewise, the outer diameter or outer edge 77 is substantially concentric with respect to the inner edge 75, and is sized to assist in providing a desired type of gas circulation within the furnace enclosure 12 during operation of the furnace 10 -- with the desired general type of gas flow being indicated schematically by such arrows as are displayed within the confines of the furnace enclosure 12 in the view that is provided by FIG. 1.

In forming the casting 71, the endless loops of chain 81, 83 are positioned in a suitably configured mold (not shown) that supports the chain loops 81, 83 so that, when nodular iron is poured into the mold to form the casting 71, the chain loops 81, 83 become substantially fully embedded within the nodular iron material (except for spaced portions 86, 88 of the inner and outer chain loops 81, 83, respectively, that extend through the passages 79 at inner and outer locations that are in close proximity to the curved inner and outer formations 76, 78). As is best seen in the right half of FIG. 9, only portions of selected ones of the links that form the chains 81, 83 actually are embedded in the material of the casting 71 at locations where the chains 81, 83 extend through opposed end regions of the passages 79.

In preferred practice, the chain loops 81, 83 are comprised of uncoated steel "crane chain" of nominal ¼ inch size. More particularly, in preferred practice, the chain loops 81, 83 are comprised of welded, elongate links that, in accordance with ASTM standard A56-39 for "crane chain" calls for ¼ inch nominal crane chain to be formed from welded link stock that has an actual cross sectional diameter of about 9/32 inch, with the elongate links each having "outside length" and "outside width" dimensions of about 1 27/64 inch and about 1 inch, respectively; with a one-hundred-link piece of such chain measuring about 86 inches in length; with the nominal weight of a one hundred foot length of such chain weighing about 115 pounds; with the chain having a "Safe Working Load" rating of about 1060 pounds; and with the chain having a "Break Test Load" rating of about 3,535 pounds.

The nodular iron material from which the convector plate 70 is formed as a casting will withstand (to a much better degree that will convector plates that are formed in other ways and/or utilizing other materials, e.g., a convector plate ((not shown)) that has been formed strictly as a steel weldment) the rigors that are encountered as the convector plate 70 is employed in a high temperature environment. The loops 81, 83 of welded steel chain that are at least partially embedded in the material of the casting 71 serve not only to reinforce the casting 71 against breakage, but also serve quite effectively to assist in holding portions of the casting 71 together in the event that the casting 71 has cracked (or otherwise "failed") due to fatigue, or has been impacted so strongly as to cause cracking and/or breakage. By at least partially embedding the endless loops of steel chain 81, 83 within the nodular iron material of the casting 71, the possibility of "shattering" of the convector plate 70 (which can result in large pieces of the casting 71 breaking away from other portions of the casting 71 and falling to the floor during handling of a convector plate by a crane or the like) is minimized.

A discussion of the significant (and genuinely "non-obvious") nature of the improvement that is provided by forming convector plates as castings of nodular iron that have steel chain stock at least partially embedded therein would not be complete without putting the present development into proper perspective as by bringing to the attention of the reader the fact that the disclosure of the referenced Parent Case (Ser. No. 07/373,672) presents a proposal that calls for reinforced castings of nodular iron to be utilized as convector plates, with such plates be reinforced by at least partially embedding steel reinforcing rod stock in the cast nodular iron. Nor would the discussion presented here be complete without pointing out that, while the afore-described proposal of the referenced Parent Case initially appeared to show genuine promise in addressing the problems of enhancing both convector plate service longevity and shatter resistance, the proposal of the Parent Case has not proven to provide any thing like the remarkable enhanced convector plate service life and shatter resistance that is achieved as by substituting steel chain in place of rigid steel reinforcement stock.

The much improved result that has been obtained as by substituting steel chain for steel reinforcement stock is in not taught or suggested in the prior art. Moreover, the substantial improvements in longevity of service life and in shatter resistance that are provided by substituting steel chain for steel reinforcing rod represent an "unexpected result" that is entirely beyond the bounds of "obviousness" to those who are skilled in the art. The importance of the contribution that is represented by the present invention to the enhancement of safety (especially for those individuals who must work near where cranes are being used to position convector plates as annealing furnaces are loaded and unloaded) cannot be over emphasized. Clearly the present invention goes a very long way toward addressing a serious need that has been present in industry for many years—a need that has been unsuccessfully and/or inadequately addressed by many prior proposals.

Having described the improved character of the convector plates 70 (which represent significant features of the present invention), the description (that was begun earlier in this document) of features of the "preferred environment" within which the improved, shatter-resistant convector plates 70 are utilized will continue—it being pointed out that the environmental description that is presented herein largely parallels corresponding descriptions that appear in several of the cases that are cross referenced at the beginning of this document.

Referring to FIGS. 1, 2, 5, 6A, 7 and 7B, it will be understood that the outer cooling ring 110 can be thought of as a relatively rugged, very durably constructed "heat sink." Further, the "heat sink" provided by the outer ring 110 is used in combination with the more lightly constructed inner cooling ring 210 that can be thought of as providing a very efficient supplemental heat exchange device.

The nodular iron castings 113 from which the outer ring 110 is formed will withstand the rigors that are encountered as the ring 110 is employed to withdraw heat energy from hot circulating gases, and to transfer this heat energy to flows of cooling fluids that are circulated through the conduits 114. The durable character of the outer ring 110 enables it to be "turned on" (i.e., to have flows of cooling fluid initiated through its conduits 114) at relatively high temperatures of about 600–900 degrees F., a most preferred temperature being about 800 degrees F. The outer cooling ring 110 acts as a "heat sink" that will, in a gradual and unobtrusive manner, serve to initiate the expedited withdrawal of heat energy from gases being circulated within the confines of the enclosure 12. The flows of cooling fluid through the conduits 114 of the outer ring 110 are continued until the temperature of the gases within the enclosure 12 has been reduced to a predetermined temperature, typically within the range of about 150–300 degrees F., a most preferred temperature being about 220 degrees F., at which temperature the enclosure 12 can be opened without causing deleterious effects to the annealed coils 32, 34, 36 that comprise the charge 30.

The inner cooling ring 210 performs a very efficient transfer of heat energy from gases that are circulating within the enclosure to such cooling fluid as is circulated through the conduit 214. Preferably the inner ring 210 is "turned on" (i.e., has its coolant flow initiated) when gases within the enclosure 12 have reached a relatively lower temperature than is present when the coolant flows in the outer ring 110 are initiated, whereby the inner cooling ring 210 is subjected to a lesser "shock" than is incurred by the outer cooling ring 110. Typically the gas temperature at which coolant flow is initiated in the inner cooling ring 210 is within the range of about 400–600 degrees F., a most preferred temperature being about 500 degrees F. The flow of cooling fluid through the conduit 214 of the inner ring 210 is continued until the temperature of the gases within the enclosure 12 has been reduced to a predetermined temperature, typically within the range of about 150–300 degrees F., a most preferred temperature being about 220 degrees F., at which temperature the enclosure 12 can be opened without causing deleterious effects to the annealed coils 32, 34, 36 that comprise the charge 30.

While the inner ring 210 is shown as having a single conduit 214 that defines a single coolant flow path, this ring too can be formed as an assembly of segments (or otherwise) to provide a plurality of cooling conduits that define a plurality of coolant flow paths.

The fins 211 of the inner cooling ring 210 are oriented and structured to minimize aerodynamic obstruction, to aid in directing gas flows along desired paths, and to maximize heat exchange surface area. Preferably the fins 211 are formed from carbon steel but are copper coated or copper covered to maximize their heat exchange effectiveness. Because the inner ring 210 is subjected to a lesser thermal shock than the outer ring 110, the inner ring 210 can have its conduit 214 formed from stainless steel, to which the copper covered carbon steel fins 211 are welded.

The center casting 51 is preferably formed as a single member, using nodular cast iron. The charge support plate 53, however, is preferably formed from gray iron. While a charge support plate 53 formed from gray iron will almost always experience some radial cracking in the environment of an annealing furnace, gray iron is nonetheless preferred because it tends to retain its configuration, i.e., its top surface will tend to remain desirably planar. Other materials, such as nodular cast iron, tend not to crack and could be used in place of gray iron; however, gray iron is preferred inasmuch as other materials such as nodular iron may tend to warp or otherwise distort such that the top support surface they would provide to support the charge of metal 30 to be annealed could become undesirably non-planar.

Radial cracking of a charge support plate 53 can be partially controlled or at least confined by providing the charge support plate 53 with radially extending lines of weakness 59, as is best seen in FIGS. 4, 12 and 13. By this arrangement, if radial cracks do form, they will tend to form along the lines of weakness 59 thereby, at worst, tending to cause the charge support plate 53 to be divided along the lines of weakness 59 into two or more segments. The resulting segments are prevented from moving relative to the underlying central casting 51 by virtue of the extension of their depending formations 61 into the space located among the inner ends of the vanes 60 of the central casting 51, and by virtue of the abutting engagement of the shoulder 63 with inner ends of the vanes 60.

While features of the present invention (e.g., features of chain-reinforced nodular iron castings that form the convector plates) have been described and illustrated as being used in combination with each other, it will be understood that these features also may be used independently one from another.

While the lengths of chain that are at least partially embedded within convector plates in accordance with the preferred practice of the present invention are described as comprising "endless loops," those skilled in the art will understand that arrangements of embedded chain other than "endless loops" can serve in a substantially equivalent manner to provide desired improvements in longevity and shatter resistance, whereby other chain arrangements (e.g., a spiral of chain that include reaches that encircle the center opening 80 and that are at least partially embedded within a nodular iron casting that forms a convector plate) can provide similar benefits to the preferred embodiment described herein—and such alternate arrangements are intended to be covered by the claims that follow.

While paths followed by the endless loops 81, 83 have been described herein as being "substantially circular" and/or "substantially concentric" and/or "substantially constant" in their spacing from the inner and outer diameters 75, 77, it will be understood by those who are skilled in the art that the described arrangement represents the "preferred embodiment" and that other arrangements of lengths of chain and/or chain loops likewise can provide beneficial results—and such alternate arrangements are intended to be covered by the claims that follow.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. While orientation terms as "upwardly," "downwardly," "inwardly," "outwardly" and the like have been utilized in describing the invention, these terms should not be interpreted as being limiting. It is intended that the patent shall cover, by suitable expression in the appended claims, whatever features of patentable novelty exist in the invention disclosed.

What is claimed is:

1. A convector plate for positioning in an annealing furnace at a location between a pair of adjacent, vertically stacked coils of metal that are supported atop a base structure of an annealing furnace for being annealed within a closed, controlled environment that is defined by the annealing furnace, wherein the convector plate comprises:

a) a flat, annular structure formed as a casting of nodular iron and having an inner structural portion that defines an inner diameter that extends substantially coaxially about an imaginary center axis, an outer structural portion that defines an outer diameter that extends substantially coaxially about said imaginary center axis, and central structural portions that rigidly interconnect the inner and outer structural portions;

b) link chain reinforcement means for minimizing shattering or separation of large portions of the plate including at least one length of steel link chain which forms at least one loop that extends along a path that is substantially circular, with said circular path being greater in diameter than said inner diameter but being of a smaller diameter than said outer diameter, with said circular path extending substantially coaxially about said imaginary center axis;

c) the casting of nodular iron being cast in-situ about said link chain reinforcement means to embed at least major portions of the at least one loop of steel link chain in the casting; and, d) flow passage means for directing annealing gases including a plurality of substantially radially extending flow passages that are defined by the inner, outer and central structural portions of the casting such that the radially extending passages extend between inner end regions located near the inner diameter of the casting, and outer end regions located near the outer diameter of the casting.

2. The convector plate of claim 1 wherein the at least one loop of steel link chain includes a loop of steel chain that extends through the inner structural portions of the casting along a path that is substantially circular and extends substantially coaxially about said imaginary center axis.

3. The convector plate of claim 1 wherein the at least one loop of steel link chain includes a loop of steel chain that extends through the outer structural portions of the casting along a path that is substantially circular and extends substantially coaxially about said imaginary center axis.

4. The convector plate of claim 1 wherein the at least one loop of steel link chain includes an inner loop of steel chain that extends through the inner structural portions of the casting along a path that is substantially circular and extends substantially coaxially about said imaginary center axis, and an outer loop of steel chain that extends through the outer structural portions of the casting along a path that is substantially circular and extends substantially coaxially about said imaginary center axis.

5. The convector plate of claim 4, wherein the inner loop of steel chain is comprised of welded links that define an endless inner loop of chain, and wherein the outer loop of steel chain is comprised of welded links that define an endless outer loop of chain.

6. The convector plate of claim 1 wherein the central portions of the casting define an array of substantially radially extending formations that have inner end regions that connect with the inner structural portions, and that have outer end regions that connect with the outer structural portions, with each adjacent pair of such formations being spaced apart so as to define portions of one of the radially extending flow paths therebetween.

7. The convector plate of claim 1 wherein the steel link steel chain is formed from commercially available welded-link chain with links thereof being formed from uncoated steel that has a cross-sectional diameter that is within the range of about 3/16 inch to about 5/16 inch in diameter.

8. A convector plate for positioning in an annealing furnace at a location between first and second coils of metal that are arranged such that the second coil is above the first coil, with the first coil being supported atop a base structure of the annealing furnace for being annealed within a closed, controlled environment that is defined by the annealing furnace, and with a convector plate being positioned between the first and second coils such that the convector plate is supported by the first coil, and such that the second coil is supported by the convector plate, wherein the convector plate comprises an annular structure that has inner, outer and central portions that are formed as a one-piece nodular iron casting that has been cast in-situ about a length of steel link chain, wherein at least major portions of the length of steel link chain are embedded within the nodular iron casting, wherein with the convector plate defines a plurality of radially extending gas flow passages between the first and second coils, and wherein the steel link chain is at least one endless loop comprised of a plurality of links.

9. The convector plate of claim 8 wherein the steel link chain is welded-link steel chain.

10. The convector plate of claim 8 wherein the inner portions of the casting define an inner diameter that extends substantially coaxially about an imaginary center axis, the outer portions of the casting define an outer diameter that extends substantially coaxially about said imaginary center axis, and the length of steel link chain extends along a substantially annular path that also extends substantially coaxially about said imaginary center axis.

11. The convector plate of claim 10 wherein the at least one loop of steel link chain includes an endless loop of steel chain that extends through the inner portions of the casting along a path that is substantially circular and extends substantially coaxially about said imaginary center axis.

12. The convector plate of claim 10 wherein the at least one loop of steel link chain includes an endless loop of steel chain that extends through the outer portions of the casting along a path that is substantially circular and extends substantially coaxially about said imaginary center axis.

13. The convector plate of claim 10 wherein the at least one loop of steel link chain includes an endless inner loop of steel chain that extends through the inner portions of the casting along a path that is substantially circular and extends substantially coaxially about said imaginary center axis, and an outer endless loop of steel chain that extends through the outer portions of the casting along a path that is substantially circular and extends substantially coaxially about said imaginary center axis.

* * * * *